US008235028B2

(12) United States Patent
Hidano et al.

(10) Patent No.: US 8,235,028 B2
(45) Date of Patent: Aug. 7, 2012

(54) HERMETICALLY SEALED FUEL TANK APPARATUS

(75) Inventors: Koichi Hidano, Shimotsuke (JP); Masakazu Kitamoto, Shimotsuke (JP); Mitsunobu Yamamoto, Ohtawara (JP); Hiroshi Kitamura, Mooka (JP); Yoshikazu Kaneyasu, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 407 days.

(21) Appl. No.: 12/576,286

(22) Filed: Oct. 9, 2009

(65) Prior Publication Data

US 2010/0126476 A1 May 27, 2010

(30) Foreign Application Priority Data

Nov. 26, 2008 (JP) ..... 2008-300361

(51) Int. Cl.
*F02M 33/02* (2006.01)

(52) U.S. Cl. ..... 123/519; 73/114.39

(58) Field of Classification Search ..... 123/518, 123/519, 520; 73/114.39
See application file for complete search history.

(56) References Cited

U.S. PATENT DOCUMENTS

| | | | | |
|---|---|---|---|---|
| 4,702,216 | A * | 10/1987 | Haruta et al. | 123/520 |
| 4,852,761 | A * | 8/1989 | Turner et al. | 123/519 |
| 5,067,468 | A * | 11/1991 | Otowa et al. | 123/520 |
| 5,197,442 | A * | 3/1993 | Blumenstock et al. | 123/520 |
| 5,467,641 | A * | 11/1995 | Williams et al. | 73/49.7 |
| 5,570,674 | A * | 11/1996 | Izumiura et al. | 123/690 |
| 5,850,819 | A * | 12/1998 | Kunimitsu et al. | 123/520 |
| 6,182,693 | B1 * | 2/2001 | Stack et al. | 123/519 |
| 6,257,050 | B1 * | 7/2001 | Nagano et al. | 73/47 |
| 6,354,280 | B1 * | 3/2002 | Itakura et al. | 123/519 |
| 6,463,915 | B2 * | 10/2002 | Ozaki et al. | 123/519 |
| 6,966,215 | B2 * | 11/2005 | Amano et al. | 73/49.2 |
| 7,204,239 | B2 | 4/2007 | Iriyama | |
| 7,383,825 | B2 * | 6/2008 | Mills | 123/516 |
| 7,980,229 | B2 * | 7/2011 | Menke | 123/519 |
| 2001/0029931 | A1 * | 10/2001 | Burke et al. | 123/520 |
| 2005/0109327 | A1 * | 5/2005 | Reddy | 123/519 |
| 2007/0113831 | A1 * | 5/2007 | Hoke et al. | 123/519 |
| 2008/0060618 | A1 * | 3/2008 | Daikuhara | 123/518 |
| 2009/0308357 | A1 * | 12/2009 | Kono et al. | 123/514 |
| 2010/0101541 | A1 * | 4/2010 | Grunwald et al. | 123/518 |
| 2011/0203947 | A1 * | 8/2011 | Ogawa | 206/216 |

FOREIGN PATENT DOCUMENTS

| | | |
|---|---|---|
| JP | 11-125154 A | 5/1999 |
| JP | 2004-100514 A | 4/2004 |
| JP | 2004-156468 | 6/2004 |
| JP | 2005-016406 | 1/2005 |

(Continued)

*Primary Examiner* — Stephen K Cronin
*Assistant Examiner* — Arnold Castro
(74) *Attorney, Agent, or Firm* — Carrier Blackman & Associates, P.C.; William D. Blackman; Joseph P. Carrier

(57) ABSTRACT

A hermetically sealed fuel tank apparatus includes a pressure-resistant fuel tank for storing a fuel therein, the pressure-resistant fuel tank being capable of holding an internal pressure equal to or higher than the atmospheric pressure, a fuel vapor inlet pipe for introducing a fuel vapor produced in the pressure-resistant fuel tank, a canister contained in the pressure-resistant fuel tank and connected to the fuel vapor inlet pipe for adsorbing the fuel vapor, a drain passage through which the canister communicates with external air, and a shutoff valve connected to the drain passage and normally closed to hermetically seal the pressure-resistant fuel tank.

7 Claims, 4 Drawing Sheets

FOREIGN PATENT DOCUMENTS

| | | | |
|---|---|---|---|
| JP | 2005-054704 | A | 3/2005 |
| JP | 2006-037783 | A | 2/2006 |
| JP | 2007-009849 | A | 1/2007 |
| JP | 2007-270777 | A | 10/2007 |

* cited by examiner

HERMETICALLY SEALED FUEL TANK APPARATUS

CROSS-REFERENCE TO RELATED APPLICATION

This application is based upon and claims the benefit of priority from Patent Application No. 2008-300361 filed on Nov. 26, 2008, in the Japan Patent Office, of which the contents are incorporated herein by reference.

BACKGROUND OF THE INVENTION

1. Field of the Invention

The present invention relates to a hermetically sealed fuel tank apparatus having a fuel tank for storing a fuel and a canister for adsorbing a fuel vapor in the fuel tank.

2. Description of the Related Art

It is known in the art that a fuel tank is used to supply a fuel to an internal combustion engine on a motor vehicle. While the fuel is stored in the fuel tank, the fuel evaporates into a fuel vapor. To prevent the fuel vapor from dissipating from the fuel tank into the atmosphere, a canister is combined with the fuel tank to trap the fuel vapor.

The canister is filled with an adsorbent such as activated carbon particles for trapping the fuel vapor by way of adsorption. When the internal combustion engine starts to operate, the fuel vapor trapped by the canister is purged through a purge passage into the intake passage of the internal combustion engine. Since the trapped fuel vapor is purged into the intake passage, breakthrough (flowing out) of the fuel vapor from the canister drain is reduced.

There is known in the art a failure diagnosing apparatus for a fuel vapor purge system as disclosed in Japanese Laid-Open Patent Publication No. 2004-156468, for example. The fuel vapor purge system combined with the disclosed failure diagnosing apparatus has a canister disposed in a fuel tank and an evaporation path including the canister and the fuel tank. A fuel vapor produced in the fuel tank is trapped by the canister. The fuel vapor trapped by the canister is purged through a purge passage into the intake passage of an internal combustion engine that is combined with the fuel tank. In the fuel vapor purge system, the failure diagnosing apparatus operates to diagnose a leakage failure of the fuel vapor from the evaporation path.

The failure diagnosing apparatus includes an air delivery means for delivering a gas which is present in either one of the fuel tank and the canister to the other of the fuel tank and the canister, and a determination means for determining a leakage failure of the fuel vapor from the evaporation path based on the difference between the internal pressure of the canister and the internal pressure of the fuel tank when the gas delivery means is in operation.

Japanese Laid-Open Patent Publication No. 2005-016406 reveals an apparatus for controlling a hermetically sealed fuel tank system including a fuel tank for storing a fuel, a canister for adsorbing an evaporated fuel in the fuel tank, a vapor passage interconnecting the fuel tank and the canister, and a control valve for selectively opening and closing the vapor passage. When the control valve is closed, the fuel tank is hermetically sealed. As the fuel tank starts being supplied with the fuel, the control valve is opened. The control apparatus includes a control means for temporarily closing the control valve after the fuel tank starts being supplied with the fuel, and determining whether the fuel tank is being supplied with the fuel or not based on a pressure change in the fuel tank which is responsive to the closing of the control valve.

If the internal combustion engine has not been started over a long period of time, then the fuel vapor is purged from the canister much less frequently. In a hybrid vehicle system which employs an internal combustion engine and a motor in combination, it is desirable that the canister be hermetically sealed to reduce breakthrough of the fuel vapor from the canister.

According to Japanese Laid-Open Patent Publication No. 2004-156468, the canister communicates with the atmosphere through an atmosphere inlet passage which has an atmosphere shutoff valve. Since the atmosphere shutoff valve is normally open, the canister is not of a hermetically sealed structure. Consequently, if the fuel vapor is purged from the canister infrequently, then breakthrough of the fuel vapor from the canister tends to increase.

According to Japanese Laid-Open Patent Publication No. 2005-016406, the canister is disposed outside of the fuel tank, and is likely to fail to have a sufficient pressure strength to resist the hermetically sealing pressure to which the canister is subjected. Therefore, the canister may not be able to hold the activated carbon particles securely and may suffer performance failures due to the insufficient pressure strength.

SUMMARY OF THE INVENTION

It is a major object of the present invention to provide a hermetically sealed fuel tank apparatus which does not require a canister itself to have a high mechanical strength for pressure resistance, and which is capable of economically and reliably providing a pressure-resistant, hermetically sealed canister.

A hermetically sealed fuel tank apparatus according to the present invention includes a pressure-resistant fuel tank for storing a fuel therein, the pressure-resistant fuel tank being capable of holding an internal pressure equal to or higher than the atmospheric pressure, a fuel vapor inlet pipe for introducing a fuel vapor produced in the pressure-resistant fuel tank, a canister connected to the fuel vapor inlet pipe for adsorbing the fuel vapor, a drain passage through which the canister communicates with external air, a pressure-resistant case structure housing the canister therein, the pressure-resistant case structure being capable of holding an internal pressure equal to or higher than the atmospheric pressure, and a shutoff valve connected to the drain passage and normally closed to hermetically seal the pressure-resistant case structure, wherein the shutoff valve is opened only when the pressure is to be released.

The canister is disposed in the pressure-resistant case structure which is capable of holding an internal pressure equal to or higher than the atmospheric pressure, and the pressure-resistant case structure is hermetically sealed by the normally closed shutoff valve. Therefore, the outside pressure of the canister is the same as the pressure inside the pressure-resistant case structure, thereby reducing the difference between the inner and outer pressures of the canister. The canister thus does not require a high mechanical strength for pressure resistance. Consequently, the canister which is pressure-resistant and hermetically sealed can economically and reliably be produced, and any fuel vapor breakthrough from the canister is minimized.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
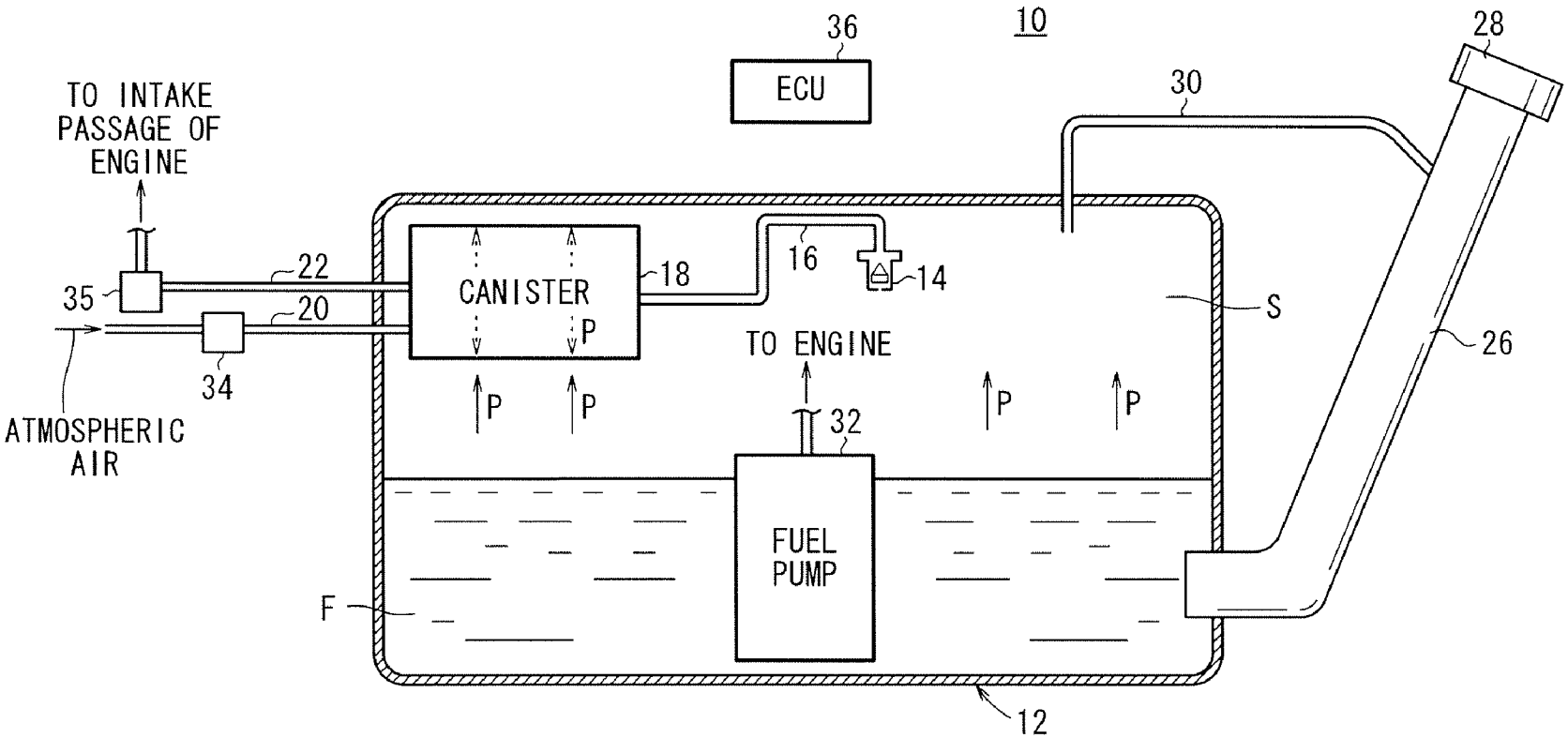
FIG. 1 is a schematic cross-sectional view of a hermetically sealed fuel tank apparatus according to a first embodiment of the present invention.

As shown in FIG. 1, a hermetically sealed fuel tank apparatus 10 according to a first embodiment of the present invention comprises a pressure-resistant fuel tank 12 for storing a fuel F therein, the pressure-resistant fuel tank 12 being capable of holding an internal pressure equal to or higher than the atmospheric pressure, a vapor passage (fuel vapor inlet pipe) 16 for introducing a fuel vapor produced in the pressure-resistant fuel tank 12 through a float 14, a canister 18 connected to the vapor passage 16 for adsorbing the fuel vapor, a drain passage 20 through which the canister 18 communicates with the external air and for introducing the external air (atmospheric air) into the canister 18 when the fuel is supplied to the pressure-resistant fuel tank 12 or when the fuel vapor is drawn in, and a purge passage 22 for purging the fuel vapor adsorbed by the canister 18 into an intake passage which supplies air to an engine, not shown, when the engine is in operation.

The pressure-resistant fuel tank 12 is of a pressure-resistant structure capable of withstanding the internal pressure equal to or higher than the atmospheric pressure. A fuel filler pipe 26 has an end connected to the pressure-resistant fuel tank 12. A cap 28 is removably mounted on the other end of the fuel filler pipe 26. A breather pipe 30 has an end connected to the fuel filler pipe 26 near the cap 28 and an opposite end extending into a space S within the pressure-resistant fuel tank 12.

The pressure-resistant fuel tank 12 houses therein a fuel pump 32 for supplying the fuel F stored in the pressure-resistant fuel tank 12 to the engine. The canister 18 and the float 14 are disposed in the space S within the pressure-resistant fuel tank 12. The canister 18 is filled with an adsorbent, not shown, such as activated carbon particles. The drain passage 20 serves to vent the fuel vapor from the canister 18 to the atmosphere. A shutoff valve 34 is connected to the drain passage 20. The shutoff valve 34 is normally closed and is opened only when the pressure in the canister 18 is to be released.

Since the canister 18 is disposed in the space S within the pressure-resistant fuel tank 12, the pressure-resistant fuel tank 12 is of a pressure-resistant case structure capable of holding the internal pressure equal to or higher than the atmospheric pressure. When the shutoff valve 34 connected to the drain passage 20 is closed, the pressure-resistant case structure (the pressure-resistant fuel tank 12) in which the canister 18 is housed is hermetically sealed.

A purge control valve 35 is connected to the purge passage 22. The purge control valve 35 is normally closed. As described later, when the canister 18 is to be hermetically sealed, the purge control valve 35 and the shutoff valve 34 are closed.

The hermetically sealed fuel tank apparatus 10 is controlled for its operation by an ECU (Electronic Control Unit) 36.

Operation of the hermetically sealed fuel tank apparatus 10 will be described below.

Part of the fuel F that is stored in the pressure-resistant fuel tank 12 evaporates into a fuel vapor, which fills up the space S. The fuel vapor is then introduced from the float 14 through the vapor passage 16 into the canister 18. In the canister 18, the fuel vapor is adsorbed and trapped by the adsorbent, not shown.

At this time, the shutoff valve 34 is closed to hermetically seal the pressure-resistant fuel tank 12 which houses the canister 18 therein. More specifically, the pressure-resistant fuel tank 12 and the canister 18 are kept in a hermetically sealed state, and the canister 18 is placed in the pressure-resistant fuel tank (pressure-resistant case structure) 12 that is in the hermetically sealed state.

If the internal combustion engine has not been started over a long period of time, and the fuel vapor is purged from the canister 18 much less frequently, then the fuel vapor produced by the evaporation of the fuel F increases with time. Therefore, the pressure in the space S increases, and so does the pressure in the canister 18 which is held in fluid communication with the space S via the vapor passage 16.

According to the first embodiment, the pressure-resistant fuel tank 12 is capable of holding an internal pressure equal to or higher than the atmospheric pressure and keeping a certain pressure within the space S. The canister 18 has its outer wall surface subject to the pressure P of the fuel vapor which exists in the space S, and the pressure P of the fuel vapor that is introduced into the canister 18 acts on the inner wall surface of the canister 18.

Since the pressure P acts on the outer and inner wall surfaces of the canister 18, the canister 18 is not required to have a high mechanical strength for pressure resistance. Consequently, the pressure-resistant, hermetically sealed canister 18 can economically and reliably be produced, and any fuel vapor breakthrough from the canister 18 is minimized.

According to the first embodiment, furthermore, the normally closed shutoff valve 34 is connected to the drain passage 20 from the canister 18. Provided the purge control valve 35 is closed, the pressure-resistant fuel tank 12 and the canister 18 can be hermetically sealed by the shutoff valve 34 alone. In addition, since a pressure checking shutoff valve used to detect a leakage failure between the pressure-resistant fuel tank 12 and the canister 18 may double as the shutoff valve 34, the number of parts that make up the hermetically sealed fuel tank apparatus 10 is reduced. Specifically, the drain passage 20 is closed by the shutoff valve 34, and the internal pressure of the pressure-resistant fuel tank 12 is measured by a tank internal pressure sensor, not shown, to detect a leakage failure of the pressure-resistant fuel tank 12 and the canister 18.

The canister 18 is disposed in the pressure-resistant fuel tank 12. Accordingly, the external space around the pressure-resistant fuel tank 12 can effectively be utilized, and the entire hermetically-sealed fuel tank apparatus 10 can easily be made compact.

When the non-illustrated engine is started, the fuel F stored in the pressure-resistant fuel tank 12 is supplied to the engine by the fuel pump 32. At this time, the intake passage, not shown, develops a negative pressure therein. The purge control valve 35 is opened to allow the fuel vapor trapped in the canister 18 to be drawn into the purge passage 22 and purged into the intake passage under the negative pressure developed therein. At the same time, the shutoff valve 34 is opened to introduce external air through the drain passage 20 into the canister 18. The fuel vapor trapped in the canister 18 is mixed with the external air flowing into the canister 18, and purged into the intake passage.

Figure 2:
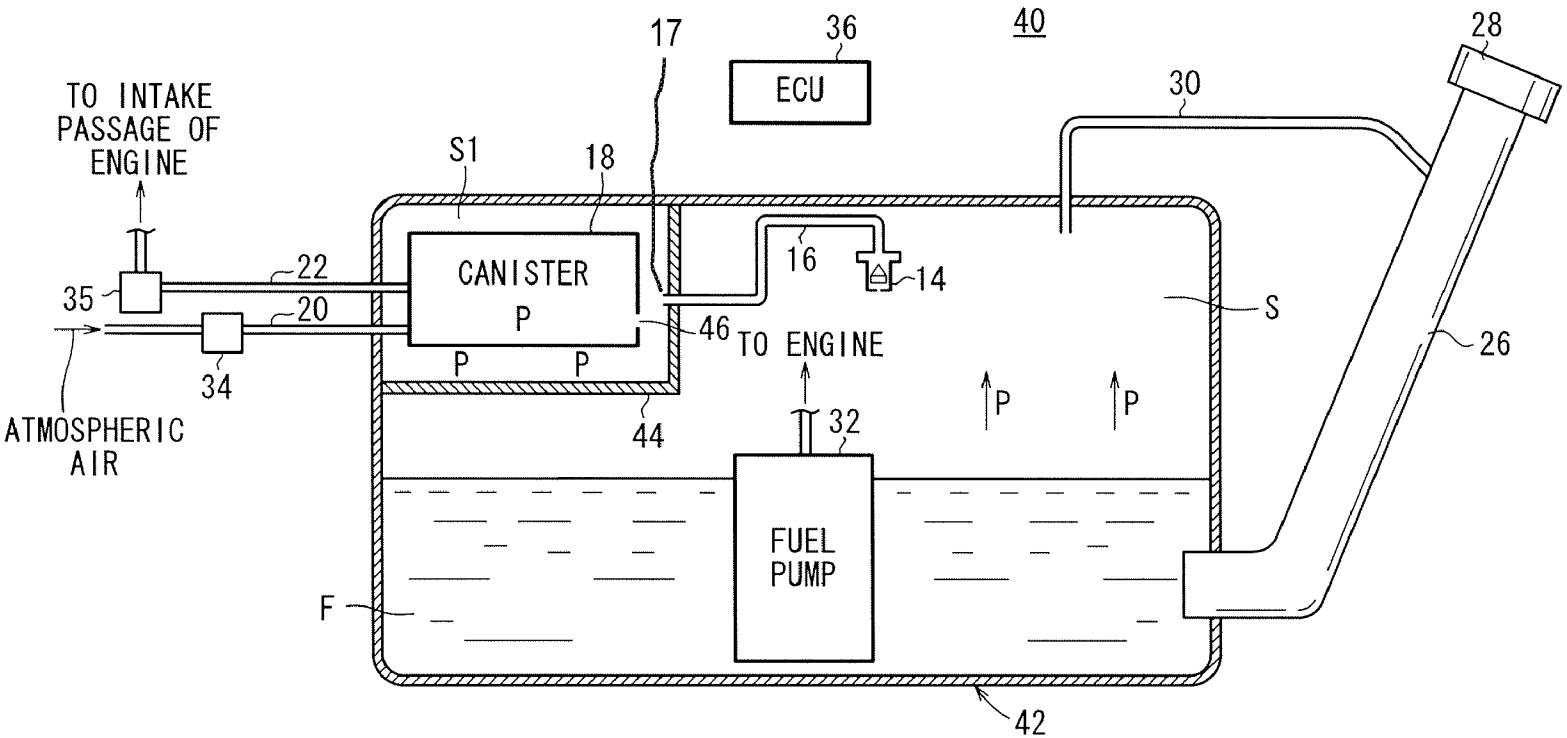
FIG. 2 is a schematic cross-sectional view of a hermetically sealed fuel tank apparatus according to a second embodiment of the present invention.

FIG. 2 schematically shows in cross section a hermetically sealed fuel tank apparatus 40 according to a second embodiment of the present invention. Those parts of the hermetically sealed fuel tank apparatus 40 which are identical to those of the hermetically sealed fuel tank apparatus 10 according to the first embodiment are denoted by identical reference characters, and will not be described in detail below. Those parts of the hermetically sealed fuel tank apparatus according to third and fourth embodiments of the present invention which are identical to those of the hermetically sealed fuel tank apparatus 10 according to the first embodiment are also denoted by identical reference characters, and will not be described in detail below.

As shown in FIG. 2, the hermetically sealed fuel tank apparatus 40 includes a pressure-resistant fuel tank 42 having a closed space S1 therein which is surrounded by a wall 44. The canister 18 is disposed in the closed space S1 and has an inlet opening 46 defined in a wall thereof which is held in fluid communication with the closed space S1. The fuel vapor inlet pipe defining the vapor passage 16 extends through the wall 44 and ends at an inlet pipe end portion 17 which is connected to the wall 44 and is open into the closed space S1. The inlet pipe end portion 17 is spaced apart from the inlet opening 46 of the canister 18. The fuel vapor inlet pipe is configured to equalize pressure between the hollow space S of the pressure-resistant fuel tank 42 and the closed space S1 of the pressure-resistant case structure defined by the wall 44.

According to the second embodiment, the fuel vapor that is produced in the space S is introduced from the float 14 through the vapor passage 16 into the closed space S1. Therefore, the closed space S1 is kept under the same pressure P as the pressure in the space S. The canister 18 has the opening 46 which is open into the closed space S1. Accordingly, the fuel vapor is reliably delivered to the canister 18, and the pressure in the canister 18 is maintained at the same level as the pressure in the closed space S1.

According to the second embodiment, therefore, the canister 18 is not required to have a high mechanical strength for pressure resistance, and hence offers the same advantages as with the first embodiment described above. Furthermore, inasmuch as the canister 18 is disposed in the closed space S1 in the pressure-resistant fuel tank 42, the canister 18 is prevented from being eroded by the fuel F stored in the pressure-resistant fuel tank 42.

Figure 3:
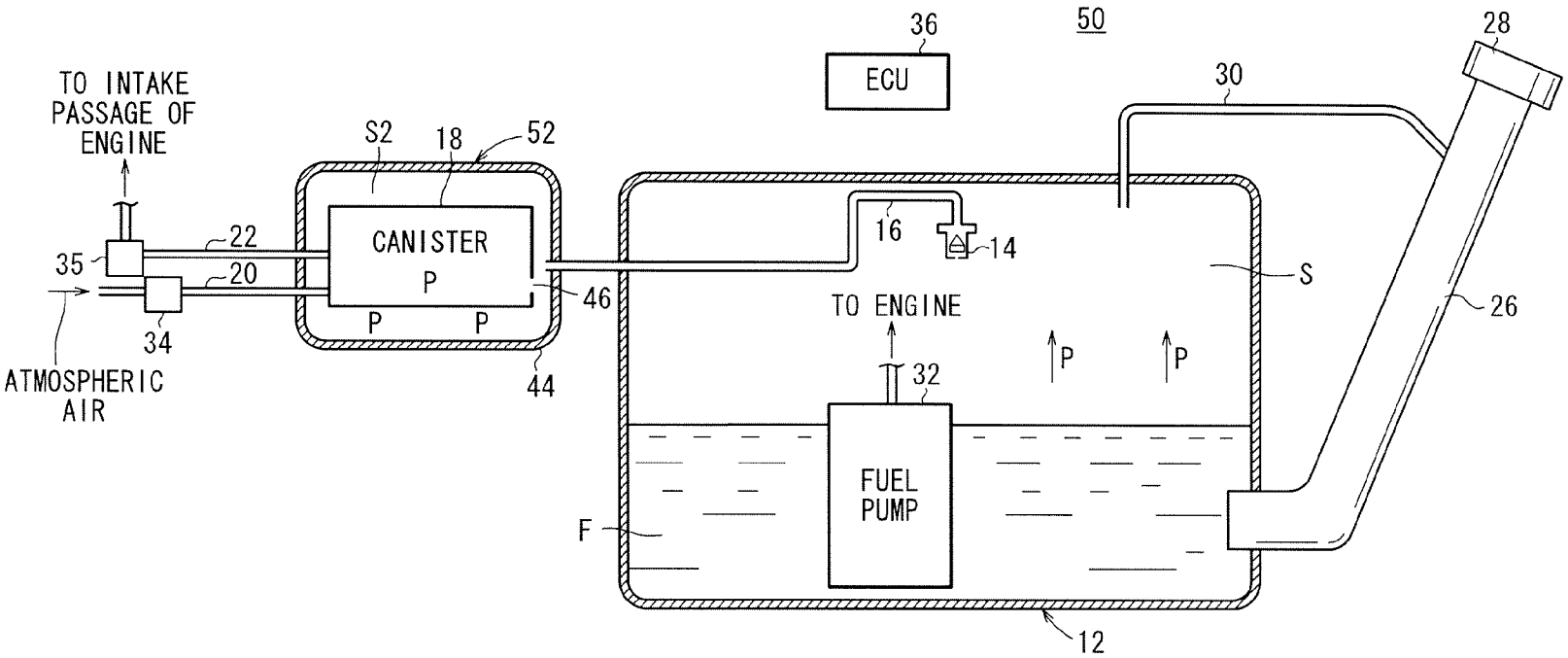
FIG. 3 is a schematic cross-sectional view of a hermetically sealed fuel tank apparatus according to a third embodiment of the present invention.

FIG. 3 schematically shows in cross section a hermetically sealed fuel tank apparatus 50 according to a third embodiment of the present invention.

The hermetically sealed fuel tank apparatus 50 includes a pressure-resistant case member 52 which is of a pressure-resistant case structure and houses the canister 18 therein. The pressure-resistant case member 52 is capable of holding an internal pressure equal to or higher than the atmospheric pressure. The pressure-resistant case member 52 is separate from the pressure-resistant fuel tank 12 and is disposed outside of the pressure-resistant fuel tank 12.

The pressure-resistant case member 52 defines a closed space S2 therein, and the canister 18 has an opening 46 defined in a wall thereof which is held in fluid communication with the closed space S2. The vapor passage 16 has an end which extends out of the pressure-resistant fuel tank 12. The end of the vapor passage 16 is connected to the wall 44 and is open into the closed space S2.

According to the third embodiment, the canister 18 is disposed in the closed space S2 in the pressure-resistant case member 52. The closed space S2 is kept under the same pressure P as the pressure in the space S in the pressure-resistant fuel tank 12 by the fuel vapor that is supplied from the space S through the vapor passage 16 to the closed space S2. The canister 18 is open into the closed space S2 through the opening 46. Accordingly, the same pressure P acts on the outer and inner wall surfaces of the canister 18.

The hermetically sealed fuel tank apparatus 50 according to the third embodiment thus offers the same advantages as the hermetically sealed fuel tank apparatus 10, 40 according to the first and second embodiments. In addition, since the pressure-resistant case member 52 is disposed outside of the pressure-resistant fuel tank 12, the pressure-resistant fuel tank 12 can have an increased fuel storage capacity.

Figure 4:
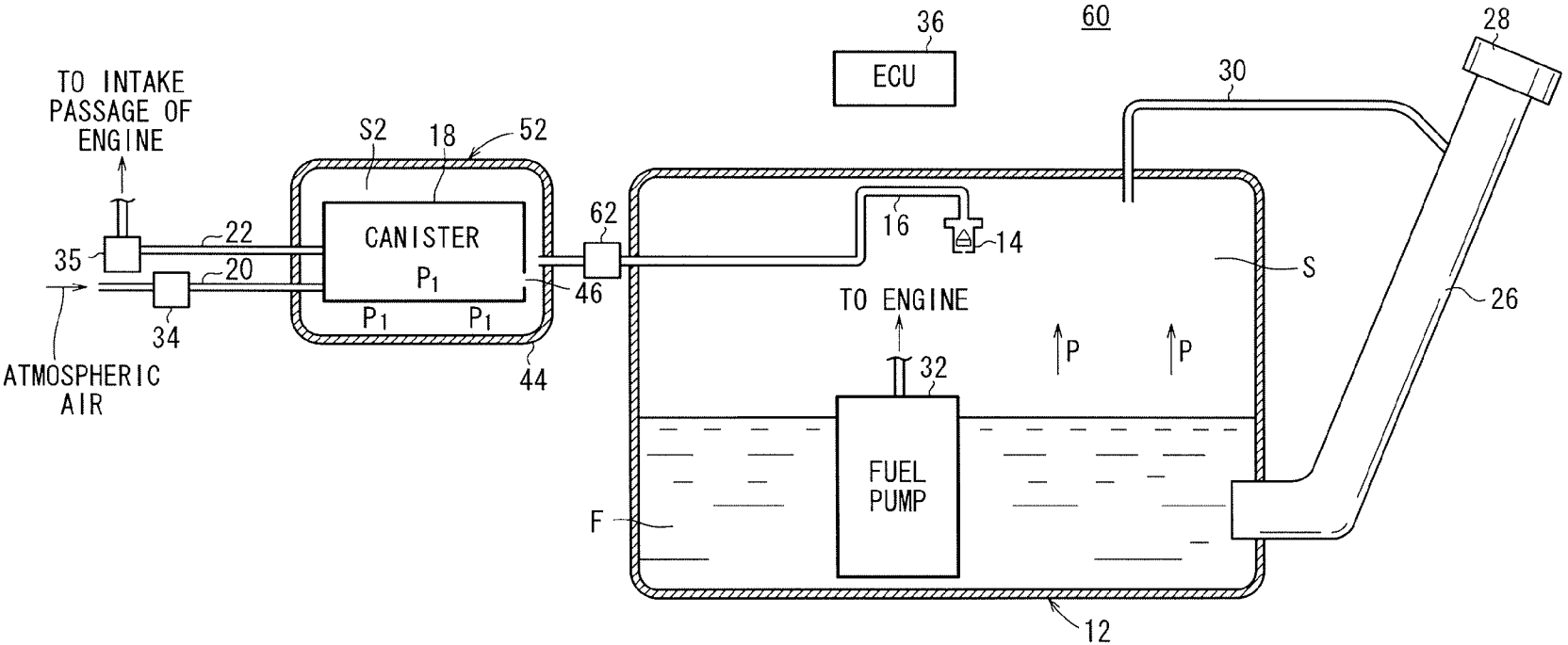
FIG. 4 is a schematic cross-sectional view of a hermetically sealed fuel tank apparatus according to a fourth embodiment of the present invention.

FIG. 4 schematically shows in cross section a hermetically sealed fuel tank apparatus 60 according to a fourth embodiment of the present invention.

The hermetically sealed fuel tank apparatus 60 includes the pressure-resistant case member 52 which is disposed outside of the pressure-resistant fuel tank 12 and houses the canister 18 therein. A shutoff valve 62 is connected to a portion of the vapor passage 16 which extends between the pressure-resistant fuel tank 12 and the pressure-resistant case member 52.

The hermetically sealed fuel tank apparatus 60 according to the fourth embodiment offers the same advantages as the hermetically sealed fuel tank apparatus 50 according to the third embodiment. Furthermore, when the shutoff valve 62 closes the vapor passage 16, the pressure in the pressure-resistant fuel tank 12 and the pressure in the pressure-resistant case member 52 can be set to respective desired levels. For example, the internal pressure P1 of the pressure-resistant case member 52 may be lower than the internal pressure P of the pressure-resistant fuel tank 12, so that the pressure-resistant case member 52 may be of a relatively low mechanical strength for pressure resistance.

When the pressure-resistant fuel tank 12 and the pressure-resistant case member 52 are isolated out of fluid communication with each other by the shutoff valve 62, the pressure-resistant fuel tank 12 and the pressure-resistant case member 52 can easily be checked for a pressure leakage.

Although certain preferred embodiments of the present invention have been shown and described in detail, it should be understood that various changes and modifications may be made therein without departing from the scope of the appended claims.

What is claimed is:

1. A hermetically sealed fuel tank apparatus comprising:

a pressure-resistant fuel tank for storing a fuel therein, the pressure-resistant fuel tank having a hollow space formed therein and being capable of holding an internal pressure equal to or higher than the atmospheric pressure;

a fuel vapor inlet pipe for introducing a fuel vapor produced in the pressure-resistant fuel tank;

a canister connected to the fuel vapor inlet pipe for adsorbing the fuel vapor, the canister comprising a canister wall having an inlet opening formed therein;

a drain passage through which the canister communicates with external air;

a pressure-resistant case structure housing the canister therein, the pressure-resistant case structure comprising a case wall defining a closed space therein in which the canister is disposed, said pressure-resistant case structure being capable of holding an internal pressure equal to or higher than the atmospheric pressure; and a shutoff valve connected to the drain passage and normally closed to hermetically seal the closed space of the pressure-resistant case structure, wherein the shutoff valve is opened only when the pressure is to be released, wherein the fuel vapor inlet pipe extends through the case wall and ends at an inlet pipe end portion which is spaced apart from the inlet opening of the canister, and wherein the fuel vapor inlet pipe is configured and arranged to equalize pressure between the hollow space of the pressure-resistant fuel tank and the closed space of the pressure-resistant case structure.

2. A hermetically sealed fuel tank apparatus according to claim 1, wherein the pressure-resistant case structure is disposed inside of the pressure-resistant fuel tank.

3. A hermetically sealed fuel tank apparatus according to claim 1, wherein the inlet pipe end portion of the fuel vapor inlet pipe opens into the closed space of the pressure-resistant case structure, whereby fuel vapor from the hollow space of the pressure-resistant fuel tank is introduced through the fuel vapor inlet pipe into said closed space.

4. A hermetically sealed fuel tank apparatus according to claim 1, wherein the fuel vapor inlet pipe is separate and spaced apart from the drain passage.

5. A hermetically sealed fuel tank apparatus according to claim 1, wherein the pressure-resistant case structure comprises a pressure-resistant case member which is separate from the pressure-resistant fuel tank and is disposed outside of the pressure-resistant fuel tank.

6. A hermetically sealed fuel tank apparatus according to claim 5, wherein the fuel vapor inlet pipe is held in fluid communication with the closed space within the pressure-resistant case member, and the canister inlet opening is in fluid communication with the closed space within the pressure-resistant case member.

7. A hermetically sealed fuel tank apparatus according to claim 5, further comprising:

a shutoff valve connected to the fuel vapor inlet pipe for isolating the hollow space of the pressure-resistant fuel tank and the closed space within the pressure-resistant case member out of fluid communication with each other.

* * * * *